US011873631B2

(12) United States Patent
Graham et al.

(10) Patent No.: US 11,873,631 B2
(45) Date of Patent: Jan. 16, 2024

(54) RESILIENT UNIVERSAL DRAIN INSERT

(71) Applicants: Heidi Graham, Charlottesville, VA (US); Kathryn Butcher Feinstone, Memphis, TN (US)

(72) Inventors: Heidi Graham, Charlottesville, VA (US); Kathryn Butcher Feinstone, Memphis, TN (US)

( * ) Notice: Subject to any disclaimer, the term of this patent is extended or adjusted under 35 U.S.C. 154(b) by 0 days.

(21) Appl. No.: 17/545,652

(22) Filed: Dec. 8, 2021

(65) Prior Publication Data

US 2022/0178128 A1 Jun. 9, 2022

Related U.S. Application Data

(60) Provisional application No. 63/122,582, filed on Dec. 8, 2020.

(51) Int. Cl.
*E03D 11/13* (2006.01)

(52) U.S. Cl.
CPC ..... *E03D 11/13* (2013.01)

(58) Field of Classification Search
CPC ..... E03D 11/13
USPC ..... 4/256.1
See application file for complete search history.

(56) References Cited

U.S. PATENT DOCUMENTS

| | | | | |
|---|---|---|---|---|
| 999,106 A | | 7/1911 | Hagaman et al. | |
| 1,886,676 A | | 11/1932 | Heuacker | |
| 2,693,603 A | | 11/1954 | Lehmann | |
| 2,811,724 A | | 11/1957 | Click et al. | |
| 3,872,521 A | | 3/1975 | Friedman | |
| 4,307,476 A | | 12/1981 | Halstad | |
| 4,555,818 A | | 12/1985 | Harrington | |
| 4,999,858 A | * | 3/1991 | Wu | E03C 1/26 4/290 |
| 5,090,152 A | * | 2/1992 | Ling | E03F 7/06 43/64 |
| 5,481,766 A | | 1/1996 | Steadman | |
| 5,546,614 A | | 8/1996 | King, II | |
| 5,581,934 A | | 12/1996 | Arnold, Sr. | |
| 6,308,350 B1 | * | 10/2001 | Marchionda | E03C 1/282 4/679 |
| 6,487,729 B2 | * | 12/2002 | Delanzo | E03C 1/264 4/286 |

(Continued)

FOREIGN PATENT DOCUMENTS

BR 202017000626 U2 * 7/2018

OTHER PUBLICATIONS

BR-202017000626-U2 Machine Translation (Year: 2023).*

*Primary Examiner* — David P Angwin
*Assistant Examiner* — William R Klotz
(74) *Attorney, Agent, or Firm* — Wolter Van Dyke Davis, PLLC; Robert L. Wolter

(57) ABSTRACT

An apparatus (100), including: a sheet (102) composed of a resilient material and configured to be flexed and then installed in a trapway of a toilet where the sheet takes on an installed shape in which a resilience of the resilient material biases the sheet outward against the trapway; at least one snare (104) protruding from a first side (142) of the sheet and thereby radially into the trapway once installed and configured to snare select items being flushed down the trapway; and a retention feature (106) extending from the sheet and configured to catch on a perimeter of an inlet of the trapway and thereby aid in holding the apparatus in place.

12 Claims, 6 Drawing Sheets

(56) References Cited

U.S. PATENT DOCUMENTS

| | | | | |
|---|---|---|---|---|
| 6,721,965 | B1 | 4/2004 | Alston | |
| 8,201,280 | B1 | 6/2012 | Nally, Jr. | |
| 8,201,281 | B2 | 6/2012 | Hanifl et al. | |
| 9,157,224 | B2 * | 10/2015 | Hanifl | E03C 1/264 |
| 9,422,693 | B2 * | 8/2016 | Johnston | E03B 7/07 |
| 9,529,943 | B2 | 12/2016 | Beck et al. | |
| 9,797,122 | B2 | 10/2017 | Maalouf et al. | |
| 11,519,162 | B1 * | 12/2022 | Amendariz | E03D 11/13 |

* cited by examiner

RESILIENT UNIVERSAL DRAIN INSERT

FIELD OF THE INVENTION

The invention relates to a resilient drain insert used to prevent clogging, in particular, of a toilet bowl.

BACKGROUND OF THE INVENTION

Toilet drain inserts are used as a way of catching items not suited for being flushed down a toilet. While these items make their way into toilet bowls in a variety of circumstances, this is known to happen particularly frequently with a subset of the elderly population who suffer with incontinence as well as dementia. Incontinence often involves the use of adult diapers or incontinence pads that are not meant to be flushed down a toilet drain. Dementia causes confusion and often leads to the flushing of these diapers/pads down the toilet. These pads rapidly expand in the drain as they quickly absorb water, causing robust clogs. These clogs require expensive and time-consuming plumbing services to remove the pad from the drainpipe. With respect to this population, existing drain inserts are highly obvious and distracting once installed in the toilet. This often leads to the person suffering with dementia trying to remove the drain insert, further decreasing the effectiveness of the known drain inserts. Hence, there is room in the art for improvement.

BRIEF DESCRIPTION OF THE DRAWINGS

The invention is explained in the following description in view of the drawings that show.

DETAILED DESCRIPTION OF THE INVENTION

The inventors have devised a unique and innovative drain insert that prevents clogs in a variety of drains in a simple, cost-effective manner, while allowing flushable items to pass through. In particular, the drain insert can be used in a trapway of a toilet to reduce chances of a clog. The drain insert does not require assembly or unique expertise to properly install or remove, has a nearly universal fit, does not pose a safety risk, and remains discreetly hidden in the drain opening.

Figure 1:
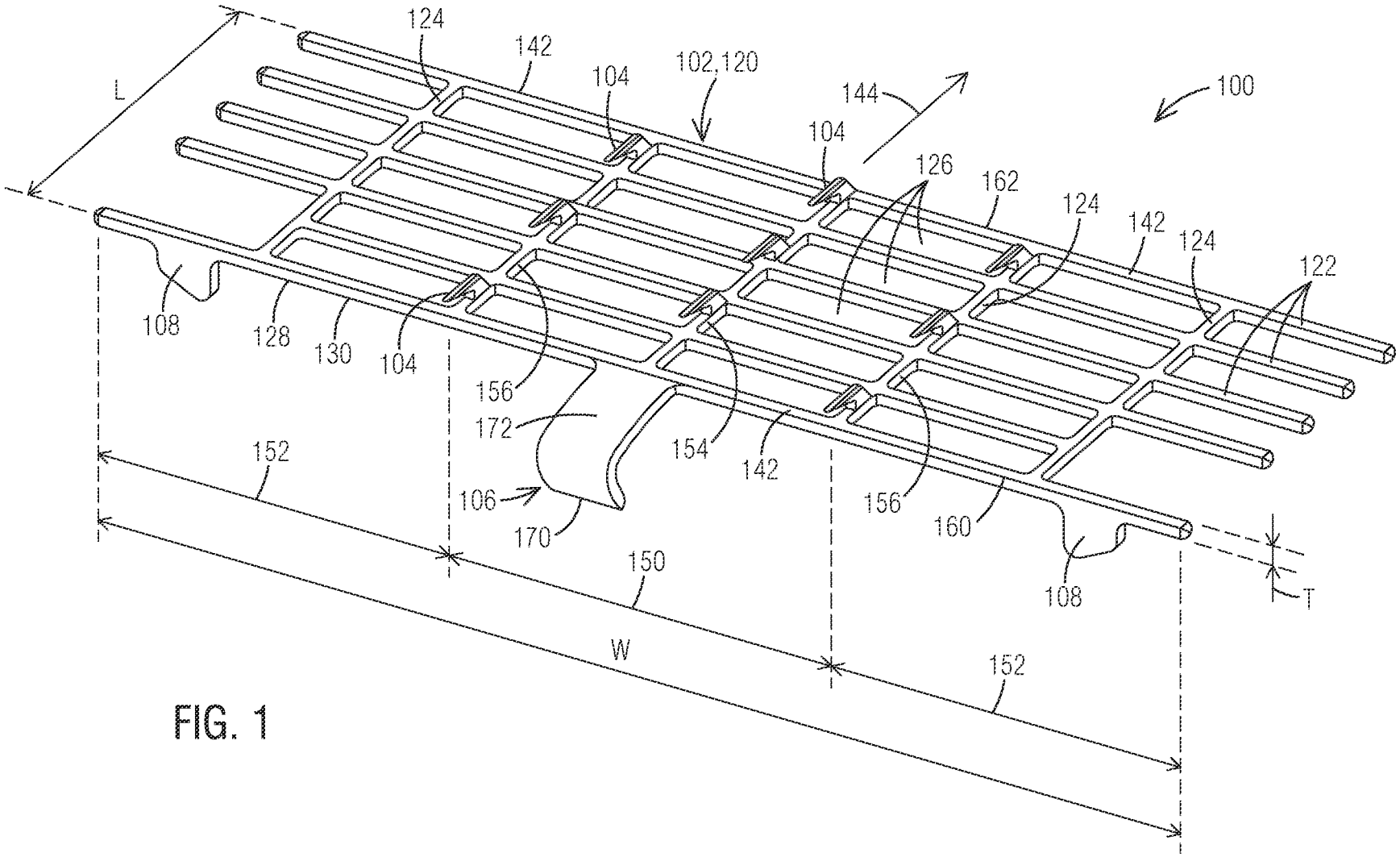
FIG. 1 is a perspective view of an example embodiment of the drain insert disclosed herein, shown in an uninstalled shape.
Figure 2:
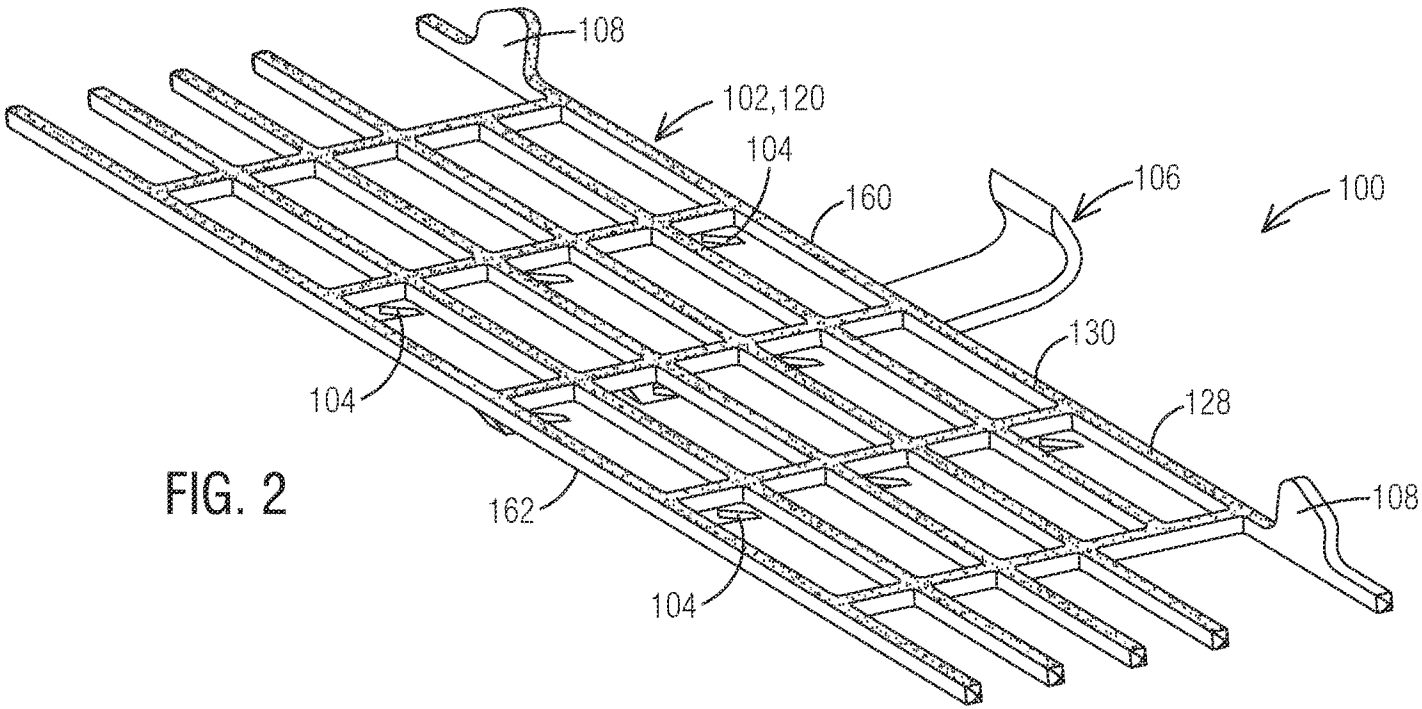
FIG. 2 is a second perspective view of the drain insert of FIG. 1, shown in the uninstalled shape.

FIGS. 1-2 are perspective views of an example embodiment of the drain insert 100 disclosed herein, shown in an uninstalled shape. The drain insert 100 includes a sheet 102, at least one snare 104, a retention feature 106, and lateral tabs 108.

The sheet 102 may be flat or not flat and may be unperforated or perforated. As shown in FIG. 1, in this embodiment, the sheet 102 is flat and optionally includes a lattice structure 120 having rows 122 that intersect columns 124 and thereby form openings 126. Alternately, the sheet 102 may take the shape of an uninterrupted/solid/non-lattice structure, or a sheet with fewer openings 126. As shown, the rows 122 and columns 124 intersect orthogonally and thereby form rectilinear openings. However, the rows 122 and columns 124 need not intersect at an angle of ninety (90) degrees; any suitable intersection angle is acceptable. Likewise, the openings 126 need not be rectilinear, but instead can take any shape that results from the selected intersection angle. Also, the relative sizes of the rows 122 with respect to the columns 124 can differ from that shown, as can the relative size of the openings 126 relative to the sizes of the rows 122 and columns 124. In other embodiments, the sheet 102 is devoid of openings 126, or includes openings only in one or more local regions. For a custom fit, ends of the rows 122 can be cut/trimmed as necessary to reach a desired size/shape in the installed position.

The sheet 102 is composed of a resilient material which is configured to be flexed/curled/rolled and then installed in a trapway of a toilet immediately downstream of the toilet bowl. Once installed, a resilience of the resilient material biases the sheet 102 outward against the trapway. Upon this expansion, the sheet 102 takes on a form-fit with the trapway which creates a geometric interlock between the sheet 102 and the trapway that helps hold the drain insert 100 in place. The outward force from the resilient creates a frictional force between the sheet 102 and the surface of the trapway that also helps hold the sheet 102 in place in the trapway. Suitable resilient materials include, for example, high-density polyethylene (HDPE), low-density polyethylene (LDPE), linear low-density polyethylene (LLDPE), copolyester blends, laminations, coextrusions, elastomers, similar materials, and any combination to these. To enhance friction between the sheet 102 and the trapway, a coating 128 may be disposed on a side 130 of the sheet 102 that contacts the trapway once the sheet 102 is installed. Example coating materials include elastomers, silicone, polyurethane, rubber, nylon, vinyl, and similar materials.

The sheet 102 includes a width W, a length L, and a thickness T. The width W defines an arc-length of the sheet 102 once installed. The length defines a length of the sheet 102 along a drainage direction of the toilet once installed. A suitable range of widths W includes but is not limited to three (3) to ten (10) inches. A suitable range of lengths L includes but is not limited to one (1) to six (6) inches. A suitable range of thicknesses T (excluding the coating 128) includes but is not limited to 0.03 to one (1) inch.

The at least one snare 104 protrudes from a first side 142 of the sheet 102 that is opposite the side 130 on which the coating 128 may be disposed. The snares 104 are shown aligned with each other and pointed upstream against a drainage direction 144. The snares 104 are configured via various hook shapes to catch select items/materials in the trapway such as textiles, diapers, and pads etc. while providing minimal obstruction to flushable matter. In a non-limiting example embodiment, the snares protrude from the side 142 from 0.01 to 0.5 inches. In other non-limiting examples, the snares 104 may protrude up to ⅛", up to ¼", or up to ⅜". The snares 104 may protrude any amount consistent with the functionality disclosed herein. There may be one snare 104 or multiple snares 104. The snares 104 may be distributed about an entire (L×W) of the sheet 102, or they may be clumped together in one or more local portions/regions.

In the embodiment shown, a middle portion 150 of the width W includes an array of snares 104 while the end portions 152 are free of snares 104. The array includes a center row 154 with snares 104 axially (lengthwise) offset from snares 104 of two side rows 156. Alternate example embodiments include any of the center row 154 being the only row, one or more of the side rows 156 being the only rows, and only one snare 104 being disposed anywhere in the middle region 150. The artisan will understand that a variety of snare configurations not explicitly disclosed herein would be acceptable, including but not limited to one or more snares 104 being located only at an upstream edge 160 of the sheet 102, only at a downstream edge 162, or only in between, in the middle portion 150 and/or in the end portions 152.

When the drain insert 100 is installed in a trapway, the middle of the width W will be in the twelve o-clock (uppermost) position and the one or more snares 104 will protrude radially inward into the trapway. Since the middle portion 150 is centered within the sheet 102, this likewise places the middle portion 150 at an upper portion of the installed drain insert 100. Many of the select items not intended to be flushed are relatively buoyant, which causes them to float toward the surface of the liquid in the trapway. Conversely, most matter intended to be flushed (i.e., items/matter not selected to be caught), is relatively non-buoyant. This places that matter remote from the upper portion of the drain insert 100. Placing the snares 104 in the middle portion 150 positions the snares 104 directly above and proximate the buoyant items while keeping the snares 104 away from the matter intended to be flushed. Under certain circumstances, this increases the chances of snaring the items that should be snared while not obstructing the items that should not be obstructed. In addition, in an example embodiment, all the leading/upstream edges of the snares are pointed/sharp, starting at the surface 142. Matter to be flushed tends to tear or split in contact with the upstream edge of a snare 104 and is thereby freed to flow down the drain. In contrast, items not intended to be flushed will catch on and thereby be retained by the snare 104. The size and location of the snares 104 also reduces the chance of injury to a user during handling and/or installation.

In an example embodiment, the retention feature 106 is disposed at a center of the width W, which places it at a top of drain insert 100 when installed. The retention feature 106 includes a center tab 170 that points away from the first side 142 and an extension 172 between the upstream edge 160 and the center tab 170. The center tab 170 is configured to catch on a perimeter of an inlet of the trapway and thereby aid in holding the drain insert 100 in place. The extension is configured to position the sheet 102 downstream of the inlet of the trapway. This positioning makes the drain insert 100 less noticeable in the toilet bowl.

The optional lateral tabs 108 are disposed in the end portions 152 and are, like the center tab 170, configured to catch on the perimeter of the inlet of the trapway and thereby aid in holding the drain insert 100 in place when the drain insert 100 is used with compatible trapways.

Figure 3:
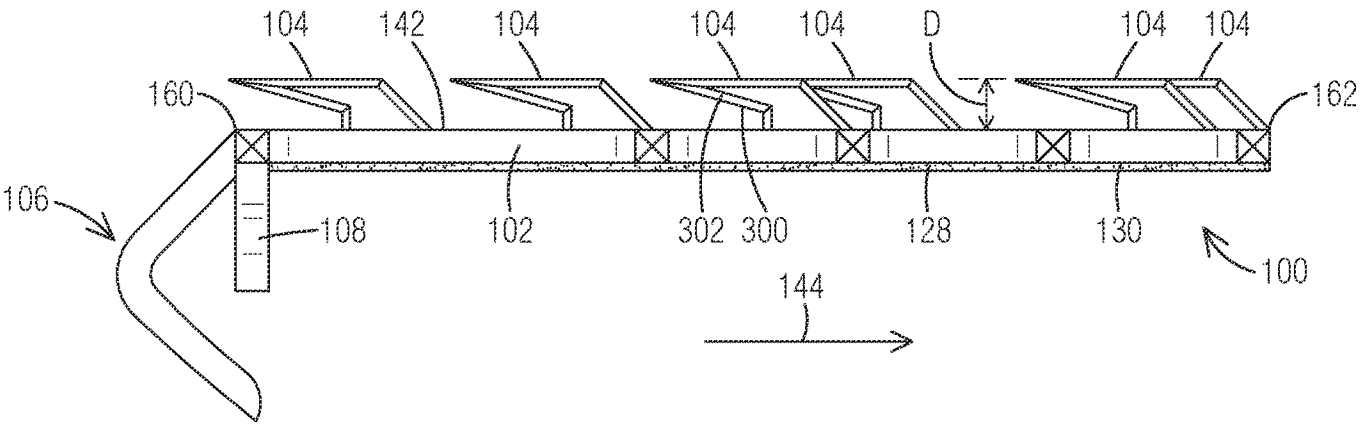
FIG. 3 is a side view of the drain insert of FIG. 1, shown in the uninstalled shape.

FIG. 3 is a side view of the drain insert 100 of FIG. 1, shown in the uninstalled shape. The snares 104 in this example embodiment, and optionally in alternate example embodiments, protrude a distance D. In this example embodiment, the upstream edge 300 of the snares 104 includes a chamfer 302 which makes the upstream edge 300 sharp for the entire distance D. While the distance D is the same for the snares 104 shown, in alternate example embodiments, the distance D can vary from one snare to the next. In an extreme example embodiment, each snare 104 can protrude a unique distance D. Each snare 104 of this example embodiment includes a sharp hook shape intended to hook and/or pierce materials in the vicinity of the snare 104. The shark hook shape in this example embodiment point upstream into the drainage direction 144. This orientation maximizes the holding power of the snares 104 against the force exerted on the snared material by the flushing action. Being aligned with the drainage direction 144 also increases the chances the snares 104 will catch the select material. This is because material being flushed will likely be traveling in a direction that has a component along the direction of travel 144, and this alignment aids in snaring the material.

Figure 4:
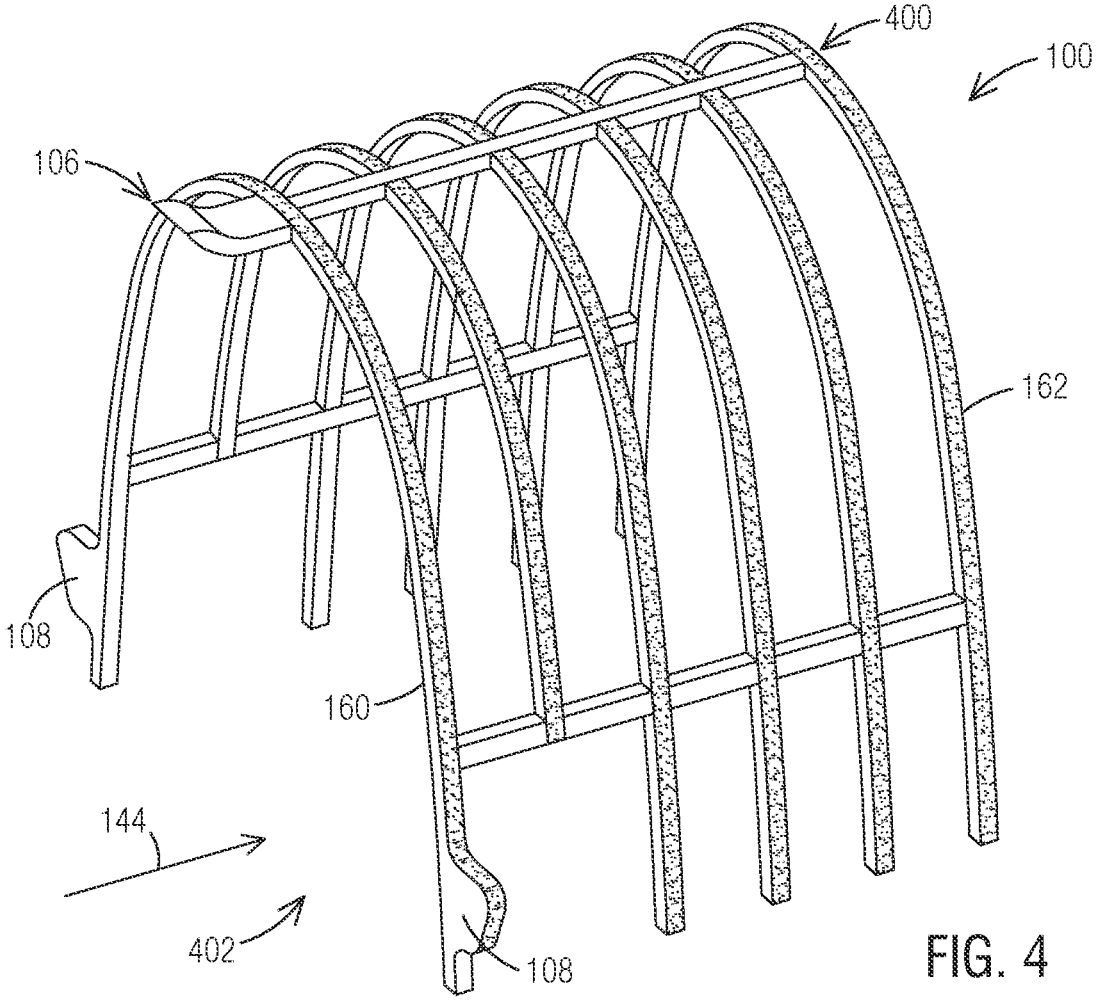
FIG. 4 is a perspective view of the drain insert of FIG. 1, shown in an installed shape.

FIG. 4 is a perspective view of the drain insert 100 of FIG. 1, shown in an installed shape and orientation. The center 400 of the width W is disposed at the twelve o-clock position. This thereby also positions the center row 154 of snares 104 and the retention feature 106 at the twelve o-clock position. The width W is also selected so that when installed, a gap 402 in the installed shape is disposed at the six o-clock position, which coincides with a bottom of the trapway. Hence, when installed as shown, the relatively buoyant items float up to the at least one snare 104 location at the twelve o-clock position, (or array of snares location in the upper portion of the installed shape). The non-buoyant matter at the bottom of the trapway is aligned with the gap 402 and is thereby free to pass through the drain insert 100 unobstructed. The width W of the sheet 102 naturally defines an arc length of the drain insert 100 once installed. For most embodiments where the drain insert 100 does not form a perfect arc (in order to conform to a shape of the trapway), the arc-length will be the rectified arc-length (the total linear length of the curved shape of the drain insert 100). While this example embodiment is shown with a gap 402, the gap 402 is not required.

Figure 5:
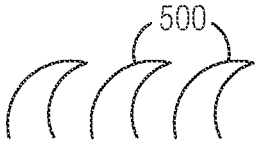
FIGS. 5-11 show various alternate example embodiments of snare shapes.
Figure 6:
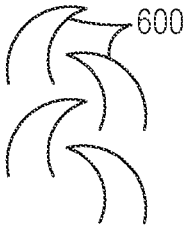
Figure 7:
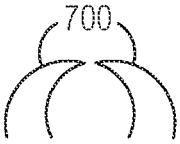
Figure 8:
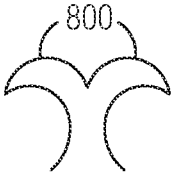
Figure 9:
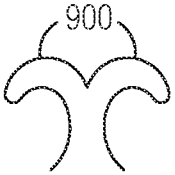
Figure 10:
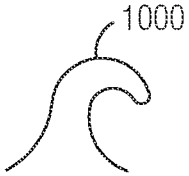
Figure 11:
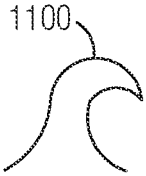

FIGS. 5-10 show various alternate example embodiments of snare shapes. FIG. 5 shows snares 500 that are aligned and have crescent hook shapes. FIG. 6 shows staggered snares 600 that are oriented at least partly toward each other and have crescent hook shapes. FIG. 7 shows aligned shares 700 that have crescent hook shapes that point toward each other. FIG. 8 shows a snare 800 having a double pointed-wave hook shape where the hooks point apart, akin to a whale-tail. FIG. 9 shows a snare 900 having a double rounded-wave hook shape where the hooks point apart, akin to a whale-tail. FIG. 10 shows a snare 1000 with a rounded-wave hook shape. FIG. 11 shows a snare 1100 with a pointed-wave hook shape. A sheet 102 may have snares 104 with one or any combination of these shapes.

Figure 12:
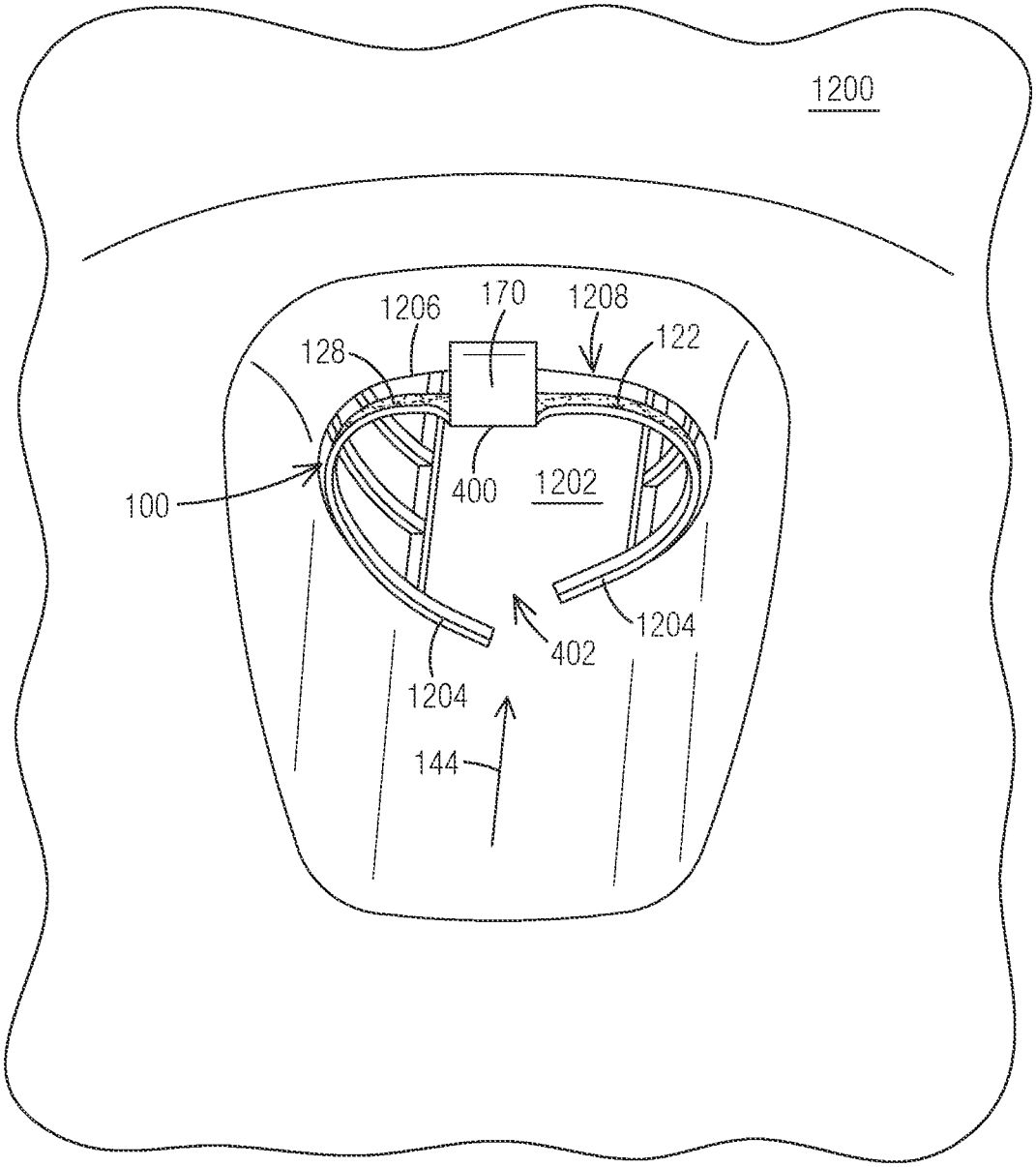
FIG. 12 is a perspective view of the drain insert of FIG. 1, shown installed in a trapway.

FIG. 12 is a perspective view of a toilet bowl 1200 and a trapway 1202 with the drain insert 100 of FIG. 1 shown installed in the trapway 1202. The drain insert 100 has been rolled, placed in the trapway 1202, and allowed to expand under its own resilience into a form fit with the trapway 1202. The resilience of the drain insert 100 also creates a frictional fit between the drain insert 100 and the trapway 1202. In the installed position, the center 400 of the width is at the top of the trapway 1202 to catch select non-flushable material, the snares 104 protrude radially inward into the trapway 1202, and the gap 402 is disposed at the bottom of the trapway 1202 to let flushable matter pass unobstructed. Ends 1204 of the rows 122 may be trimmed back from what is shown in FIG. 12 as desired to ensure flushable matter a proper fit. The retention feature 106 catches on the perimeter 1206 of the inlet 1208 of the trapway 1202 to hold the drain insert 100 in position, aided by the friction enhancing coating 128. No lateral tabs are present in this installation. Should an even less visible installation be sought, the extension 172 (not visible in FIG. 12) between the center tab 170 and the sheet 102 can be made longer. This would place the sheet 102 farther downstream in the trapway 1202 with respect to the drainage direction 144, and thereby make it less visible.

In order to remove the drain insert 100, one can simply grab the center tab 170 by hand and pull the drain insert 100 from the trapway 1202. This is possible because the resilient material flexes to permit easy removal. And debris caught can be cleared from the snares 104 by simply tilting the drain insert 100 until the debris releases from the snare 104.

Figure 13:
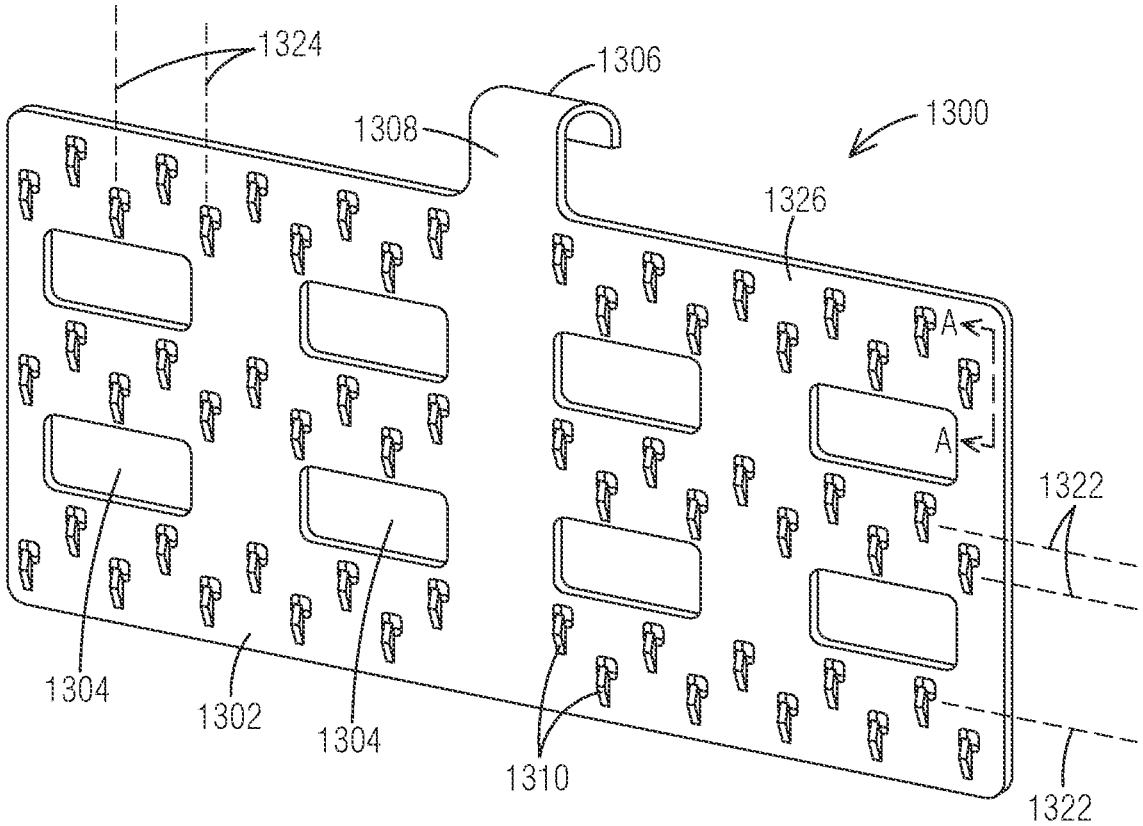
FIG. 13 is a perspective view of an alternate example embodiment of the drain insert.

FIG. 13 is a perspective view of an alternate example embodiment of the drain insert 1300. This example embodiment includes the sheet 1302 that optionally defines a lattice structure having openings 1304, the retention feature 1306, the extension 1308, and a plurality of snares 1310. The plurality of snares 1310 form an array 1320 having rows 1322 and columns 1324 of snares 1310. The sheet 1302 in this example embodiment, like the others, may be composed of a resilient material such as a plastic material. Likewise, the snares 1310 may be composed of a resilient material such as a plastic material. In an example embodiment, the sheet 1302 and the snares 1310 may be composed of the same material. The snares 1310 may be incorporated into the sheet 1302 or integrally formed with the sheet 1302. In the latter, (shown in FIG. 13), the snares 1310 and the sheet 1302 are part of a monolithic body 1326. In an example embodiment, the retention feature 1306 is also composed of the resilient material and optionally is also integrally formed in the sheet 1302 as part of the monolithic body 1326. When the snares 1310, the sheet 1302, and the retention feature 1306 are all part of a single monolithic body 1326, the insert 1300, (less any added friction coatings), can be formed by suitable processes such as molding (e.g., injection molding), additive manufacturing, and the like. This provides for a simple and inexpensive manufacturing process and a simple, inexpensive, and effective product.

Figure 14:
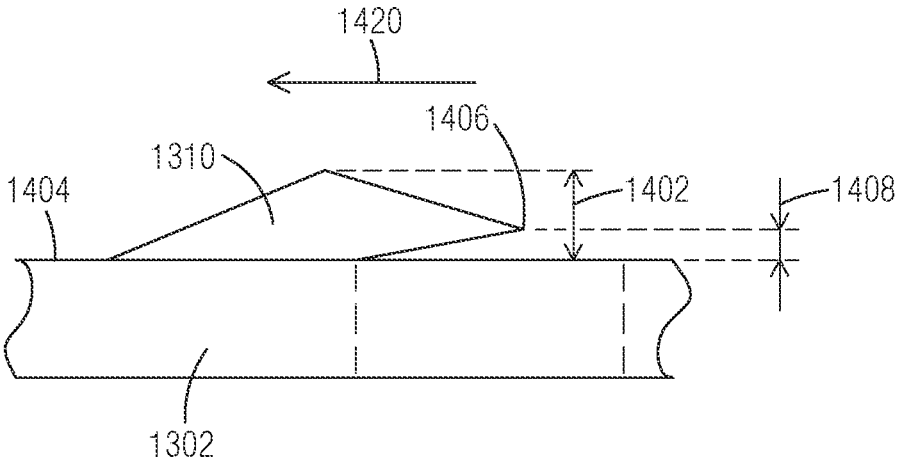
FIG. 14 is a side view taken along line A-A of FIG. 14 detailing an example embodiment of a snare of the drain insert of FIG. 13.

FIG. 14 is a side view taken along line A-A of FIG. 13 detailing an example embodiment of the snare 1310 of the drain insert 1300. In an example embodiment, the snare 1310 is characterized by a height 1402 of up to ½" above the first side 1404 of the sheet 1302. In another example embodiment, the height 1402 is up to ⅛" above the first side 1404 of the sheet 1302. In other example embodiments, the height 1402 is up to ¼", or ⅜". However, the height of any snare disclosed herein can be any dimension suitable to achieve the functionality disclosed herein. A pointed tip 1406 of the snare 1310 is disposed a distance 1408 of up to ⅛" from the first side 1404. In an example embodiment, the distance 1408 is less than 1/16". In another example embodiment, the distance 1408 is up to 0.04". In an example embodiment, the snare 1310 points in a direction opposite the drainage direction 1420. While not shown in FIG. 14, the snares of FIG. 14 may include the upstream edge 300 and chamfer 302 shown on the snare of FIG. 3.

Figure 15:
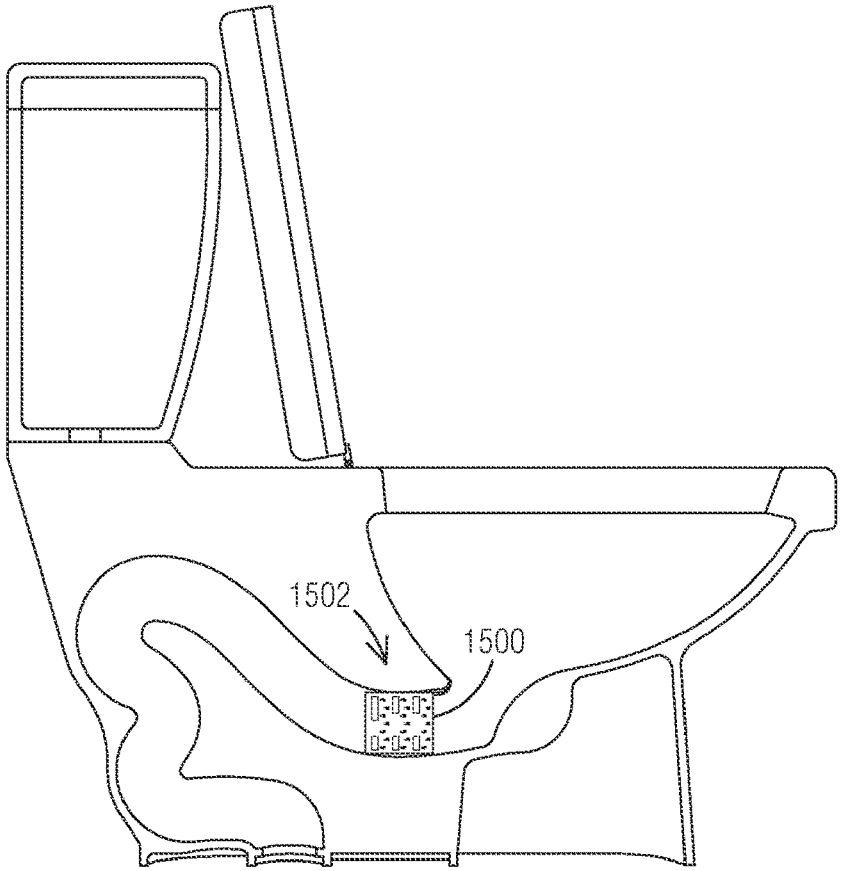
FIG. 15 is a sectional view of an example embodiment of the drain insert disposed in a trapway.

FIG. 15 is a sectional view of an example embodiment of the drain insert 1500 rolled/curled and in the installed position in a trapway 1502.

Figure 16:
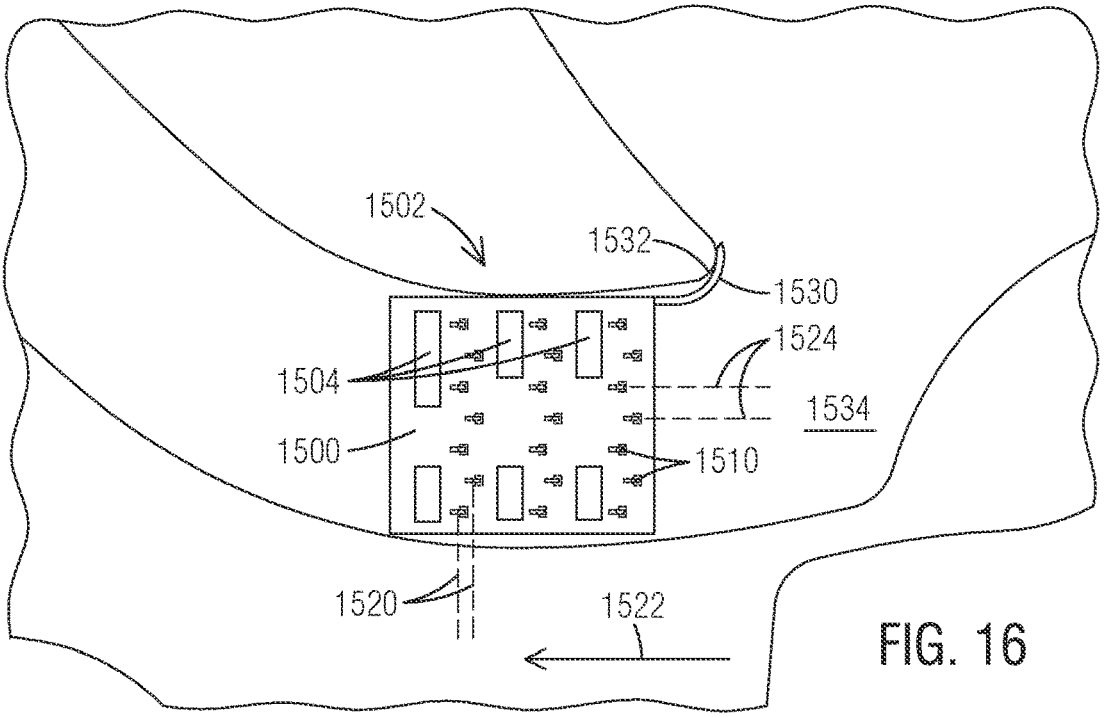
FIG. 16 is a closeup view of the drain insert of FIG. 15.

FIG. 16 is a closeup view of the drain insert of FIG. 15. In this example embodiment, the drain insert 1500 has three rows of openings 1504. As shown installed in the trapway 1502, snares 1510 are disposed at a plurality of locations 1520 along a drainage direction 1522 of the trapway 1502 and a plurality of locations 1524 around a circumference of the trapway 1502 and protrude radially into the trapway 1502 to snare material moving in the drainage direction 1522. As with other example embodiments, at least some of the snares 1510 are disposed at the twelve o-clock position when installed in the trapway 1502 as shown. In this example embodiment, all of the snares 1510 are configured to point the same direction, which is opposite the drainage direction 1522 when installed in the trapway 1502. Alternately, different snares 1510 may point different directions. Similarly, in the example embodiment shown, all of the snares 1510 are the same size and shape, though this is not necessary. The drain insert 1500 is held in place via the retention feature 1530 that catches onto the perimeter 1532 of the inlet 1534 of the trapway 1502.

In light of the above, it can be seen that the inventors have created a device that is simple to make, easy to install and remove, will not wear out, fits most trapways with little to no adjustments, requires virtually no maintenance, is unobtrusive, and is effective at catching select items which should be caught (i.e., not flushed) while allowing material that should pass do so unobstructed. Consequently, the drain insert represents an improvement in the art.

While various embodiments of the present invention have been shown and described herein, it will be obvious that such embodiments are provided by way of example only. Numerous variations, swapping of features among embodiments, changes, and substitutions may be made without departing from the invention herein. Accordingly, it is intended that the invention be limited only by the spirit and scope of the appended claims.

The invention claimed is:

1. An apparatus, comprising:

a sheet composed of a resilient material, wherein when flexed and then installed in a trapway of a toilet the sheet is configured to take an open concave shape in which a resilience of the resilient material biases the sheet outward against the trapway and in which a gap exists between ends of the sheet and at a bottom of the trapway;

at least one snare protruding from a first side of the sheet and thereby radially into the trapway once installed and configured to snare select items being flushed down the trapway; and a retention feature extending from the sheet and configured to catch on a perimeter of an inlet of the trapway and thereby aid in holding the apparatus in place, wherein when the sheet takes the open concave shape the retention feature is disposed in a middle portion of the sheet opposite the gap and at a top of the trapway.

2. The apparatus of claim 1, wherein the resilient material comprises a plastic material.

3. The apparatus of claim 1, wherein the sheet comprises a lattice that defines an array of openings.

4. The apparatus of claim 1, further comprising a friction-enhancing coating disposed on the sheet on a side opposite the at least one snare.

5. The apparatus of claim 1, wherein the at least one snare comprises a plurality of snares, wherein snares of the plurality of snares comprise respective pointed tips, and wherein the pointed tips are disposed within 1/16 inch of the first side.

6. The apparatus of claim 1, wherein both the sheet and the at least one snare comprise the resilient material.

7. The apparatus of claim 6, wherein a monolithic body consisting of the resilient material forms both the sheet and the at least one snare.

8. The apparatus of claim 7, wherein the retention feature comprises the resilient material, and wherein the monolithic body also forms the retention feature.

9. The apparatus of claim 1, wherein the at least one snare comprises a plurality of snares integrally formed in the sheet that form an array that extends along both a length and a width of the sheet so that when installed in the trapway, snares of the plurality of snares are disposed at a plurality of locations in a column along a drainage direction of the trapway and a plurality of locations around a circumference of the trapway and protrude radially into the trapway to snare material moving in the drainage direction.

10. The apparatus of claim 1, wherein the at least one snare comprises a plurality of snares, and wherein snares of the plurality of snares are oriented in a same direction.

11. The apparatus of claim 1, wherein the retention feature is centered at an upstream edge of the sheet and comprises a center tab that points away from the first side of the sheet.

12. The apparatus of claim 1, wherein the retention feature comprises the resilient material and is formed as an integral part of the sheet.

* * * * *